United States Patent [19]

Whisman et al.

[11] 4,073,719

[45] Feb. 14, 1978

[54] PROCESS FOR PREPARING LUBRICATING OIL FROM USED WASTE LUBRICATING OIL

[75] Inventors: Marvin L. Whisman; James W. Reynolds; John W. Goetzinger; Faye O. Cotton, all of Bartlesville, Okla.

[73] Assignee: United States Department of Energy, Washington, D.C.

[21] Appl. No.: 791,076

[22] Filed: Apr. 26, 1977

[51] Int. Cl.[2] ..... C10M 11/00

[52] U.S. Cl. ..... 208/180; 208/181; 208/184; 208/211

[58] Field of Search ..... 208/180, 181, 184

[56] References Cited

U.S. PATENT DOCUMENTS

| | | | |
|---|---|---|---|
| 1,766,768 | 6/1930 | Werkenthin | 208/180 |
| 3,639,229 | 2/1972 | Brownswell et al. | 208/184 |
| 3,763,036 | 10/1973 | Jordan et al. | 208/180 |
| 4,021,333 | 5/1977 | Habiby et al. | 208/181 |

*Primary Examiner*—Delbert E. Gantz

*Assistant Examiner*—James W. Hellwege

*Attorney, Agent, or Firm*—Dean E. Carlson; Frank H. Jackson; James W. Weinberger

[57] ABSTRACT

A re-refining process is described by which high-quality finished lubricating oils are prepared from used waste lubricating and crankcase oils. The used oils are stripped of water and low-boiling contaminants by vacuum distillation and then dissolved in a solvent of 1-butanol, 2-propanol and methylethyl ketone, which precipitates a sludge containing most of the solid and liquid contaminants, unspent additives, and oxidation products present in the used oil. After separating the purified oil-solvent mixture from the sludge and recovering the solvent for recycling, the purified oil is preferably fractional vacuum-distilled, forming lubricating oil distillate fractions which are then decolorized and deodorized to prepare blending stocks. The blending stocks are blended to obtain a lubricating oil base of appropriate viscosity before being mixed with an appropriate additive package to form the finished lubricating oil product.

14 Claims, 1 Drawing Figure

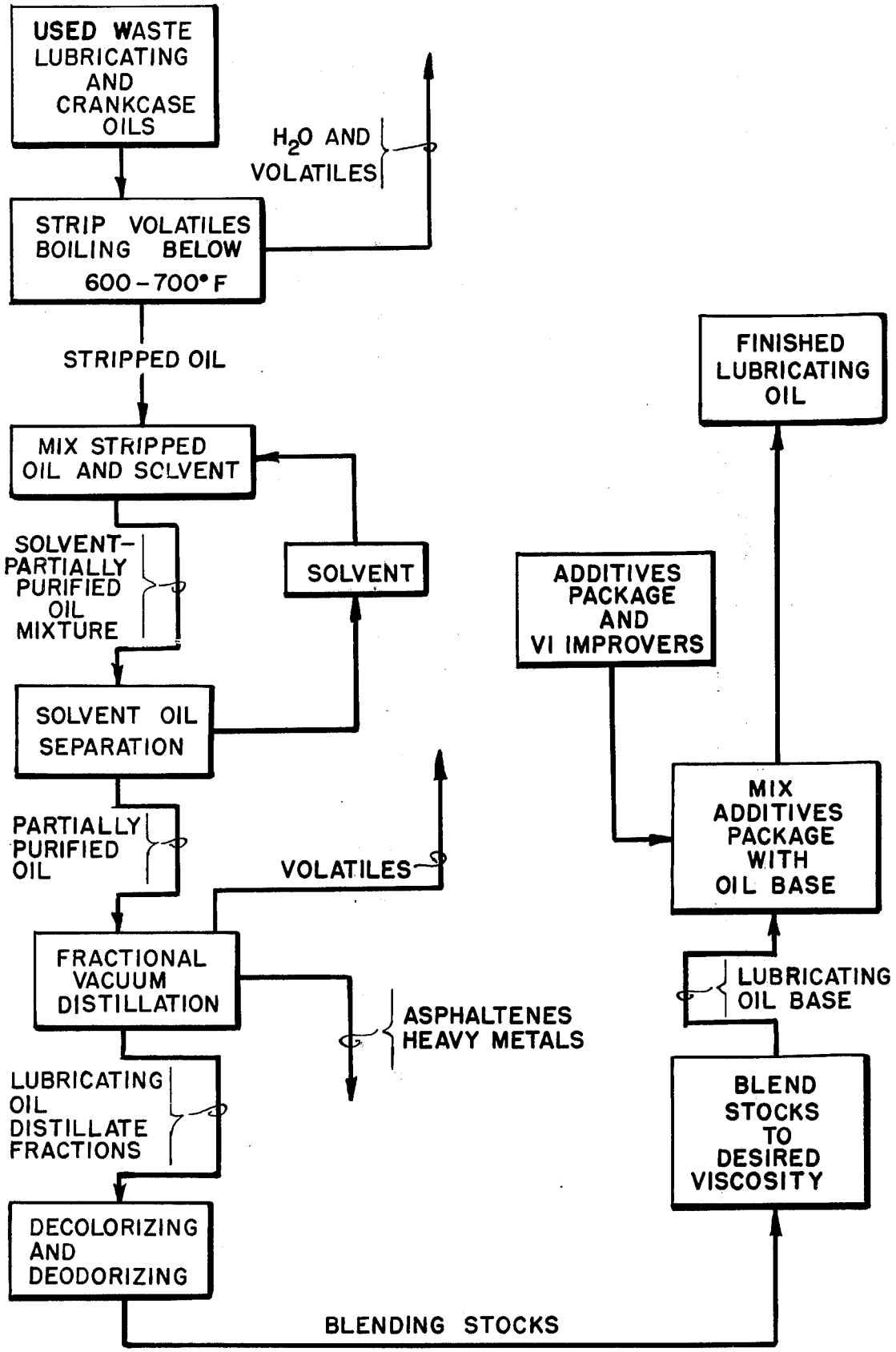
USED WASTE LUBRICATING AND CRANKCASE OILS
$H_2O$ AND VOLATILES
STRIP VOLATILES BOILING BELOW 600-700° F
STRIPPED OIL
MIX STRIPPED OIL AND SOLVENT
SOLVENT-PARTIALLY PURIFIED OIL MIXTURE
SOLVENT
SOLVENT OIL SEPARATION
PARTIALLY PURIFIED OIL
VOLATILES
FRACTIONAL VACUUM DISTILLATION
ASPHALTENES HEAVY METALS
LUBRICATING OIL DISTILLATE FRACTIONS
DECOLORIZING AND DEODORIZING
BLENDING STOCKS
FINISHED LUBRICATING OIL
ADDITIVES PACKAGE AND VI IMPROVERS
MIX ADDITIVES PACKAGE WITH OIL BASE
LUBRICATING OIL BASE
BLEND STOCKS TO DESIRED VISCOSITY

PROCESS FOR PREPARING LUBRICATING OIL FROM USED WASTE LUBRICATING OIL

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

This invention relates to an improved process for re-refining hydrocarbon oils. More specifically, this invention relates to a solvent refining process for reclaiming used lubricating oils. Still more specifically, this invention relates to a process for preparing quality lubricating oils from used waste lubricating and crankcase oils.

Shortages of petroleum have renewed attention to developing methods for conserving dwindling world supplies of crude oil until science and technology can close the gap with stimulated production, alternative energy sources and more efficient energy utilization. One approach to this problem has been to encourage better utilization of present supplies, which includes an estimated 1 billion gallons of used lubricating oil that is drained, dumped or burned each year in this country. These oils have generally been used as engine crankcase lubricants, transmission and gear oils and the like. Used lubricating oils commonly contain various additives such as detergents, antioxidants, corrosion inhibitors, and extreme pressure additives which are necessary for satisfactory performance, in addition to solid and liquid contaminants, some of which result from oxidation of the oil itself, and generally water and gasoline. Much of this oil could be recovered and reused if it were collected and if it could be effectively reprocessed. Instead, as much as one-third of this oil is indiscriminately dumped, contaminating both land and water. Much of the waste oil is burned and this, too, contributes to pollution of our environment by releasing metallic oxides from additives in the oil into the atmosphere.

A number of processes are available for the purification and reprocessing of lubricating oils. Often these processes involve the use of distillation followed by polishing or decolorizing treatment. However, to prevent coking and column fouling during distillation, some form of pretreatment is necessary to remove many of the additives and contaminants from the oil. Typically, the waste oil is first heated to drive off volatile hydrocarbons and water and then contacted with a strong mineral acid or, to a lesser extent, a caustic which precipitates out a large portion of the oil as sludge. The supernatant oil is separated from the sludge and neutralized with an acid or caustic as appropriate before distillation or other polishing or decolorizing treatment. A discussion of these and other re-refining methods is found in U.S. Bureau of Mines, Report of Investigations - RI 7884 (1974), Waste Lubricating Oil Research, An Investigation of Several Re-refining Methods.

However, the acid or caustic pretreatment processes have many disadvantages which render these processes undesirable. For example, in either process, a large percentage of the used oil is lost (up to 50%) creating large volumes of highly acidic or caustic sludge for which there is no known use and which is disposed of in a sanitary landfill or similar manner and may cause environmental pollution. The use of strong acids and caustics oftentimes alters the petroleum base composition of the lubricating oils, resulting in the loss of a substantial quantity of otherwise recoverably organic material ultimately resulting in a product deficient in properties required for high-quality lubricants. For example, the loss of higher molecular weight diaromatic and polyaromatic-polar materials may approach 70% on an original oil basis. These materials are generally associated with natural lubricity of the base oil and removal will adversely affect this parameter of the lubricant product. Likewise, the polar materials are responsible in part for natural resistance to oxidation and removal of these compounds contributes to the generally poor oxidation resistance of reprocessed lubricating oils. Both of these conditions can be overcome, to some extent, by the use of additives.

Other treatment processes have been developed, which attempt to meet the environmental objections of the previous processes. These processes utilize various liquid hydrocarbon diluents which may be combined with solvents such as alcohol or water-alcohol mixtures to form solvent precipitation solutions. A number of these solvent extraction systems were examined and reported upon in Bureau of Mines Report of Investigations RI 7925 (1974), Waste Lubricating Oil Research, Some Innovative Approaches to Reclaiming Used Crankcase Oil. While these processes do not cause a loss of the desirable aromatic compounds, neither are most of these processes effective in removing the contaminants from the waste oil and so must be combined with a more severe treatment which utilizes an acid or caustic in order to completely reprocess the waste oil.

A solvent precipitation process which effectively removes most of the additives and undesirable contaminants from used lubricating oil without destroying the natural lubricity and other desirable qualities of the base oil while providing high percentages of recovery is disclosed in copending U.S. patent application Ser. No. 734,838, filed Oct. 22, 1976 and assigned to the U.S. Energy Research and Development Administration. We have found that, by combining the pretreatment process described in the above patent application with additional, relatively mild process steps, we are able to prepare a preprocessed lubricating oil stock, which when combined with an appropriate package of additives, is able to meet or exceed the wear and lubrication standards which have been set by the automobile industry for lubricating oils.

SUMMARY OF THE INVENTION

In accordance with the process of the invention, used waste lubricating and crankcase oils are heated in a vacuum to strip water and light hydrocarbons boiling below about 600°–700° F from the oil which is then combined with a solvent of 2-propanol, methylethyl ketone and 1-butanol, which dissolves the oil while most of the metal compounds, oxidation products and additives present in the stripped oil precipitate out as a sludge. The partially purified oil-solvent mixture is separated from the sludge and the solvent recovered from the partially purified oil for recycling. The solvent-free partially purified oil is vacuum-distilled by taking the distillate overhead boiling from about 700°–1000° F, thereby forming a lubricating oil distillate and removing additional impurities such as volatiles boiling above about 1000° F, asphaltenes and metals. The lubricating oil distillate is then decolorized and deodorized to prepare the lubricating oil base to which is added the appropriate additives including viscosity index improvers, antioxidants, etc. as necessary to prepare the finished lubricating oil ready for packaging and use.

Preferably, the purified, solvent-free oil is fractionally vacuum-distilled to obtain several lubricating oil distillate fractions, which after decolorizing and deodorizing to prepare blending stocks, are blended together to obtain a lubricating oil base of a desired viscosity before being mixed with the appropriate additives to prepare the finished lubricating oil. The lubricating oil distillate may be decolorized and deodorized by either clay-contacting or by mild hydrogenation.

The process of this invention has several advantages over prior art processes for reclaiming used waste lubricating oils. For example, the sludge which results from the solvent precipitation step is chemically and hence environmentally neutral and may find utility as a road surfacing agent or as a source of heavy metals. The present process generally produces less wastes than do most prior art processes in that generally about 60–75% of the waste oil is recovered for reformulation and reuse. Most importantly, all of the purification steps are mild so that the natural lubricity and antioxidation characteristics of the petroleum are not destroyed by the process.

It is therefore one object of the invention to provide an improved process for preparing finished lubricating oils from used waste lubricating and crankcase oils.

It is a further object of the invention to provide an improved process for preparing finished lubricating oils from used waste lubricating and crankcase oils which is less harsh than prior art processes and which produces smaller quantities of a sludge which is environmentally compatible.

Finally, it is the object of the invention to provide a process for preparing finished lubricating and crankcase oils from used waste lubricating and crankcase oils which are about equal in quality to lubricating and crankcase oils prepared from virgin oil stock.

BRIEF DESCRIPTION OF THE DRAWING

The drawing is a flow diagram of the process of the invention.

DESCRIPTION OF THE PREFERRED EMBODIMENT

These and other objects of the inventnion may be met by heating the waste lubricating oil in a vacuum to strip the water and volatile materials, such as gasoline, boiling below about 600°–700° F from the waste oil, mixing the stripped oil with a solvent in a ratio of about 1 part oil to 3 parts solvent, the solvent containing about 1 part 2-propanol, 1 part methylethyl ketone and 2 parts 1-butanol, whereby the oil dissolves in the solvent and most of the oxidation products, additives, metal compounds and other impurities in the oil precipitate out as a sludge, separating the partially purified oil-solvent mixture from the sludge, separating the partially purified oil from the solvent, fractional vacuum-distilling the partially purified oil and collecting the distillate overhead in a plurality of boiling range cuts, thereby forming a plurality of lubricating oil distillate fractions of different viscosities, decolorizing and deodorizing the lubricating oil distillate fractions, thereby forming lubricating oil blending stocks of different viscosities, blending the blending stocks of different viscosities to prepare a lubricating oil base having a predetermined viscosity and mixing the lubricating oil base with the appropriate additives and viscosity index improvers, thereby forming a finished lubricating oil product.

The used lubricating oil is preferably heated to strip water and other volatile hydrocarbons such as gasolines boiling below 600°–700° F which may be present in the oil in order to prevent formation of azeotropes with the solvent which may later hinder solvent recovery. The stripping may be by any efficient method which will prevent a breakdown of the hydrocarbons in the oil, such as, for example, vacuum distillation where a temperature from about 300°–350° F at a pressure of about 2 to 10 mm Hg will provide sufficient stripping of water and volatile hydrocarbons from the oil.

The preferred solvent composition is 1 part 2-propanol (isopropyl alcohol), 1 part methylethyl ketone to 2 parts 1-butanol (n-butyl alcohol), although the amount of each component present in the solution may vary by up to about 10% by volume without unduly affecting the results attainable by the use of the solvent of the invention.

The solvent-to-used-lubricating-oil ratio may vary from about 8 to about 3 parts solvent to 1 part oil while the ratio is preferably from 4 to 3 parts solvent, and most preferably 3 parts solvent to 1 part oil.

It is preferable that contact between the solvent and the used oil take place at ambient temperatures or below. Lower temperatures, down to about 50° F (10° C), will increase the effectiveness of the solvent by causing precipitation of more of the metal compounds, additives, and oxidation products while temperatures higher than about 86°–104° F (30°–40° C) will reduce the effectiveness.

Generally, about 10% of the weight of the oil is precipitated by the solvent. The solvent-oil mixture may be separated from the precipitate by any of the usual separation methods. For example, the sludge may be allowed to settle in a tank overnight followed by decantation of the solvent-oil mixture. Alternatively, a centrifuge can be used to separate the sludge from the solvent-oil mixture immediately after mixing. The centrifuge might be used to provide either a continuous separation or a batch separation of sludge.

Recovery of the solvent mixture from the partially purified oil may be accomplished by any method known to those skilled in the art. For example, an evaporator/-stripper with a suitable vacuum system and cold traps are suitable for solvent removal and recovery. In pilot-scale studies, effective solvent stripping was accomplished using a continuous-feed distillation column operated at 150 mm Hg abs. at 345° F (174° C). These conditions left about 0.1% of the solvent in the oil so that a second pass through the column at 1 mm Hg abs. was used to improve solvent recovery. The recovered solvent can then be recycled to purify additional dehydrated waste oil, while the partially purified oil separated from the solvent is processed further.

The partially purified oil is next vacuum-distilled to remove additional impurities such as volatiles boiling above about 1000° F and asphaltenes and metals which may remain in the partially purified oil. The oil may be fractional vacuum-distilled by taking a plurality of boiling range cuts from the distillate overhead or by taking a single cut of the distillate overhead boiling from about 700° to 1000° F. Fractional distillation is preferred since this provides a number of lubricating distillate fractions having different viscosities which can later be blended in various proportions to obtain lubricating oil bases having predetermined viscosities necessary for different commercial purposes. By taking a single boiling range fraction only a finished lubricating oil having a viscosity in the range of SAE 20 is generally attainable. It is important that the temperature of the oil be maintained below the coking temperature (i.e. about 600° F) to avoid cracking. Thus temperatures between 300° and 600° F at pressures of 100 to 200 mm Hg have proven satisfactory.

The decolorizing and deodorizing step is necessary to stabilize the oil and to complete removal of small amounts of additives and undesirable impurities still remaining in the oil. This step may be accomplished by any of several processes useful for this purpose, for example clay-contacting or mild hydrogenation. Although the hydrogenation method is preferred, it is more expensive and clay-contacting provides a satisfactory product.

In clay-contacting, excellent results are attainable by mixing the oil with from 0.2 to about 1 lb of clay per gallon oil, preferably 0.3 to 0.5 lbs/gallon, and heating the resultant slurry to from 300° to 500° F, preferably about 380° to 420° F, for periods of 30 minutes to 3 hours. Times longer than about 3 hours encourage oxidation of the oil, while larger quantities of clay merely increase the amount of waste which must be disposed of. Oxidation may also be controlled by introducing an inert atmosphere such as $H_2$ or $N_2$ into the tank. Alternatively, a steam sparge will also provide excellent results, since, in addition to controlling oxidation, it helps to sweep impurities from the oil. It is preferred that the oil and clay be separated as soon as possible after the contact time is met to obtain a better product. Separation can be accomplished by any well-known separation method such as filtering. Any acid-activated bleaching clay such as Filtrol grade 20 ®, Superfiltrol ® or Tonsil ® was found to provide satisfactory results.

Mild hydrogenation as an alternative process to effect odor and color improvement of the reprocessed lubricating oil is preferred if adequate quantities of hydrogen are available at practical prices. Typical conditions of hydrogenation to produce a satisfactory finished lubricating oil with neutral odor and light color include an operating temperature of about 500°–700° F with a temperature in the range of 600° F preferred. The hydrogen partial pressure may range between about 400 and 900 psig, with a preferred level near 650 psig. Space velocities may vary between about 0.5 and 2.5 vol/vol/hr with a preferred value of 1. Hydrogen rates of from 250–2000 Standard Cubic Foot/Barrel (SCFB) have been found satisfactory, with a rate of 1500 SCFB being preferred. The catalyst employed may be substantially any of the known hydrofinishing catalysts which promote desired reactions which result in the removal of undesirable unsaturated materials and polar compounds. A metal of Groups II-A, II-B, VI-B, or VIII of the Periodic Table of Elements, an oxide of a metal of Groups II-A, II-B, VI-B, or VIII, or a sulfide of a metal of Groups II-A, II-B, VI-B, or VIII is satisfactory as catalyst material. Typical catalysts are cobalt molybdate and nickel molybdate on an inert substrate such as alumina.

Preferably, the lubricating oil distillate fractions are decolorized and deodorized individually before blending to the desired viscosity, although the fractions may first be blended to the desired viscosity and the blended oil decolorized and deodorized.

Blending of the lubricating oil blending stocks is varied depending upon the service requirement of the finished product. Typically, 150 SUS solvent neutral base stock is blended with 250 SUS solvent neutral base stock to obtain a lubricating oil base with a viscosity in the range of 170 to 180 SUS (100° F). The addition of appropriate additives and viscosity index improvers to this base will produce an SAE 10W30 grade finished lubricating oil.

Additives and viscosity index improvers must be added to the lubricating oil base to provide the finished product with the properties necessary for its intended use. The choice of such additives and viscosity index improvers will depend upon the composition and physical characteristics of the oil base and the availability of the additives.

The following series of examples are given only to illustrate the process of the invention and are not to be taken as limiting the scope of the invention which is defined by the appended claims.

EXAMPLE I

A portion of used lubrication oil amounting to about 4 liters was heated to 300° F (184° C) under a pressure of 10 mm Hg to remove light hydrocarbons and water. (Typical used lubricating oil feedstocks yield in the range of 5% light hydrocarbons and 5% water.) One part (2770 ml) of this dehydrated oil was subsequently mixed with 3 parts (8310 ml) of solvent and allowed to settle for 24 hours. The solvent consisted of 1 part 2-propanol, 1 part methylethyl ketone and 2 parts 1-butanol. The oil-solvent phase was separated from the precipitated sludge, and transferred to a distillation column where the solvent was removed. The first stripping of solvent was performed at 300° F (184° C) liquid temperature and atmospheric pressure. To insure complete removal of solvent, the last stage of the distillation was conducted at 300° F (184° C) liquid temperature and 10 mm external pressure. Solvent recovery amounted to 7,995 ml (96.2%), 2330 ml (84.1%) of treated oil was recovered, while the sludge amounted to 440 ml (15.9%) of the total. Subsequent fractionation of this solvent-treated oil in a wiped film evaporator produced four fractions ranging in viscosity from 71.5 to 1082 SUS as shown in Table I.

TABLE I

| Fractionation Condition and Yields | | | |
|---|---|---|---|
| Fraction Viscosity, SUS at 100° F | Yield, % | Distillation Conditions | |
| | | Temp., ° C* | Pressure |
| 71.5 | 17.52 | 290 | 5 mm Hg |
| 178.8 | 29.04 | 190 | 10 um Hg |
| 459 | 26.33 | 270 | 10 um Hg |
| 1082 | 11.38 | 350 | 10 um Hg |

*Wiped surface temperatures.

Overall oil recovered from this run was 70.88% based upon the initial dehydrated oil charge and adjusted for sampling.

EXAMPLE II

In a pilot-scale study, a quantity of used lubricating oil, solvent-treated as described in the previous example, was distilled in a wiped film evaporator with 4 sq. ft. of heat transfer area. Feedrate through the unit was varied from about 115 to 250 pounds per hour. The jacket temperature ranged from 604° to 621° F with an absolute operating pressure between 0.47 and 1.00 mm Hg. Rotor speed was 280 rpm. The yield of oil from this distillation was 77.5% based on the dry oil charge. This distilled oil was subsequently submitted to fractionation using a 4-inch flasher at a feedrate of 3–5 gallons per hour. Results of this treatment are tabulated in Table II.

TABLE II

| Yields from 4-inch Flasher Fractionation | | | |
|---|---|---|---|
| Fraction BP ° F | Yield, % | Yield, gallons | Viscosity, SUS at 100° F |
| IBP-700 | 2.00 | 3 | |
| 700–760 | 26.52 | 37 | 98.2 |
| 760–800 | 23.58 | 33 | 159.0 |
| 800–865 | 25.00 | 35 | 255.7 |
| 865+ | 14.30 | 20 | |
| Loss | 8.60 | 12 | |

EXAMPLE III

In a typical clay-contacting procedure, 24 gallons of distilled oil were charged to a cone bottom 50 gallon carbon steel tank equipped with wrap-around drum heaters. Contents of the tank were stirred vigorously using a 1 HP, 1140 rpm stirrer. Filtrol grade 20 bleaching clay was added to the oil in a ratio of about 0.5 pound of clay per gallon of oil. After combining the clay and oil, heat was then applied to the tank while the contents were stirred until a temperature of 260° F was reached. At this point a slow steam sparge of the oil was started using a perforated steam line installed near the bottom of the treatment tank. After 4 hours and 40 minutes a temperature of 385° F was reached and at 5 hours, 10 minutes, the temperature was 390° F. At this point heat application was discontinued and the oil was quenched by cooling the exterior of the treatment tank with tap water from a hose. The oil was filtered while still warm to remove the last traces of clay.

EXAMPLE IV

In another example of clay-contacting, 28 gallons of distilled oil were charged to a treatment tank with 14 pounds of Filtrol grade 20 bleaching clay. Heat and stirring were applied to the contents of the treatment vessel. After 2 hours, 8 minutes, at a temperature of 400° F, steam was injected. At 5 hours, 20 minutes, a temperature of 420° F was reached, heat was discontinued, the oil was quenched and ultimately filtered. It has been found that immediate removal of clay is necessary to achieve satisfactory color and odor improvement.

EXAMPLE V

In another example, 26 gallons of distilled used lubricating oil were charged to a treatment tank with 13 pounds of Filtrol grade 20 clay. At 2 hours, 9 minutes, at a temperature of 390° F, steam was injected. At 4 hours, 40 minutes, a temperature of 450° F was reached, and at 5 hours, 50 minutes, the oil was quenched and filtered. Results and experimental conditions of clay treating are shown in Table III.

TABLE III

| | Clay Contacting | | |
|---|---|---|---|
| | Example III | Example IV | Example V |
| Oil Color* | | | |
| Initial color | 4½ | 4½ | L5 |
| Final color | 1 | L1 ½ | 1½ |
| Steam rate lbs. $hr^{-1}gal^{-1}$ | 0.58 | 1.95 | 1.24 |
| Total steam sparge time, hrs. | 4.78 | 3.2 | 3.37 |
| Total run time, hrs. | 5.17 | 5.33 | 5.83 |
| Distillate losses, gallons | .5 | — | — |
| Final odor description | Improved | Neutral | Neutral |

*ASTM

EXAMPLE VI

An automotive lubricating oil processed by the technology described, was subjected to bench tests for definition of physical and chemical properties and to engine sequence performance tests. These latter tests were performed by an independent test laboratory on certified test stands.

Table IV shows a comparison of bench tests performed on two used oils reclaimed using the solvent refining process with a 150 SUS hydrofinished virgin base stock and a 190 SUS solvent neutral virgin base stock.

TABLE IV

| Physical and Chemical Properties of Re-refined Used Oil and Commercially Produced Virgin Base Stocks | | | | |
|---|---|---|---|---|
| | Sample | | | |
| Property | Virgin Base Stock[1] | Virgin Base Stock[2] | BSR[3] | BSR[4] |
| Viscosity | | | | |
| SUS at 100° F | 179.0 | 144.3 | 165.5 | 182.9 |
| cST at 100° F | 38.30 | 30.62 | 35.33 | 39.15 |
| SUS at 210° F | 44.7 | 42.5 | 44.2 | 45.6 |
| cST at 210° F | 5.62 | 4.95 | 5.49 | 5.91 |
| Index | 91 | 92 | 99.8 | 103 |
| Acid number | 0.0 | 0.0 | 0.0 | 0.0 |
| Carbon res., Ramsbottom, pct. | NA | NA | .23 | .23 |
| Ash, pct. | 0.00 | 0.00 | 0.00 | 0.00 |
| Aniline point, ° F | 217.0 | 217.7 | 218.1 | 220.0 |
| Oxidation stability, ASTM, D943, hrs | NA | 1,364[5] | NA | 1,340[5] |
| Copper corrosion, ASTM D130 | 1a | 1a | 1a | 1a |

NA - Not analyzed.
[1]190 SUS solvent neutral virgin base stock.
[2]150 SUS hydrofinished virgin base stock.
[3]Solvent refined 165 SUS base stock (hydrofinished).
[4]Solvent refined 180 SUS base stock (clay-contacted).
[5]Base stock contained 0.3% (wt) BHT oxidation inhibitor and 0.05% corrosion inhibitor for D943 only.

The physical and chemical characteristics of oils re-refined by the solvent refining process as determined by standard bench-scale tests are indistinguishable from those of high-quality virgin blending stocks used in producing SE quality oils. Of note is the good oxidation stability of the reclaimed oil as compared to that of one of the commercial oils derived from virgin stocks. Both were stable under test conditions well beyond 1,000 hours.

The results of IIC engine sequence tests are tabulated in Table V. A minimum rating of 8.4 (10 = clean) has been established as a criterion in evaluating the rusting characteristics of motor oils subjected to field service. This test method was designed to relate particularly to short-trip service under typical winter condition in the upper midwestern United States.

TABLE V

| Engine Test Sequence IIC Results | | | | |
|---|---|---|---|---|
| | | Sample | | |
| Rating parameter | Test limit[1] | Virgin-derived oil | BSR[3] | BSR[4] |
| Rust | 8.4 | 8.91 | 7.71 | 8.45 |

[1]10 = clean.
[2]Standard engine test reference oil.
[3]Solvent re-refined, SAE 10W30 (hydrofinished).
[4]Solvent re-refined, SAE 10W30 (clay-contacted).

Table VI contains essential data obtained form sequence IIIC tests for a standard engine reference oil and for solvent re-refined oils. The oxidation characteristics of lubricating oil are evaluated through the measurement of viscosity increase at 40 hours, piston varnish, oil-ring deposits, sludge formation, ring sticking, and cam or lifter scuffing and wear.

TABLE VI

| Engine Test Sequence IIIC Results | | | | |
|---|---|---|---|---|
| | | Sample | | |
| Rating parameter | Test limit[1] | Virgin-derived oil [2] | BSR[3] | BSR[4] |
| 100° F viscosity increase at 40 hrs, pct | +400 max | +54 | +21 | +18 |
| Piston varnish | 9.3 min[1] | 9.32 | 9.39 | 9.37 |
| Oil-ring deposits | 6.0 min[1] | 7.52 | 7.52 | 8.03 |
| Sludge | 9.0 min[1] | 9.34 | 9.69 | 9.80 |
| Ring sticking | None | None | None | None |
| Cam or lifter scuffing | None | None | None | None |
| Cam plus lifter wear, inch | 0.001 avg<br>.002 max | 0.0006<br>.0011 | 0.0004<br>.0010 | 0.0006<br>.0009 |

[1]10 = clean.
[2]Standard engine-test reference oil.
[3]Solvent re-refined, SAE 10W30 (hydrofinished).
[4]Solvent re-refined, SAE 10W30 (clay-contacted).

Sequence VC results are shown in Table VII. This test procedure evaluates crankcase motor oil with respect to sludge and varnish deposits produced by engine operation under a combination of low and midrange temperatures. This test also indicates the capacity of the oil to keep positive crankcase ventilation (PCV) valves clean and functioning properly.

TABLE VII

| Engine Test Sequence VC Results | | | | |
|---|---|---|---|---|
| | | Sample | | |
| Rating parameter | Test limit | Virgin-derived oil[1] | BSR[2] | BSR[3] |
| Total sludge | 8.5 min[4] | 8.07 | 9.54 | 9.50 |
| Total varnish | 8.0 min[4] | 7.58 | 8.40 | 8.30 |
| Piston skirt varnish | 7.9 min[4] | 7.67 | 7.91 | 7.70 |
| Oil ring clogging | 5 pct max | 0 | 0 | 0 |
| Ring sticking | None | None | None | None |

[1]Standard engine-test reference oil.
[2]Solvent re-refined, SAE 10w30 (hydrofinished).
[3]Solvent re-refined, SAE 10W30 (clay-contacted).
[4]10 = clean.

One of the solvent re-refined oils was submitted for bearing-corrosion bench tests. These tests evaluate crankcase lubricating oil resistance to oxidation and corrosion to copper-lead bearings as related to Federal Test Method 3405 of Federal Test Method STD. No. 791*a*. This procedure correlates with the Method 3405 engine test (L-38) and involves continuous operation of a bench apparatus under constant speed, temperature, air humidity, and air flow conditions for 40 hours. A new set of copper-lead connecting-rod test bearings is installed for each test. The test limit bearing weight loss by this test procedure is 40 mg. The solvent re-refined, SAE 10W30 (hydrotreated) oil showed a total bearing weight loss of only 4.6 mg in 40 hours, well below the allowable limit.

It can be seen from the preceding discussion and examples that the process of the invention provides a method for preparing good quality lubricating oils from waste lubricating and crankcase oils.

The embodiments of the invention in which an exclusive property or privilege is claimed are defined as follows:

1. A process for preparing lubricating oils from used waste lubricating oils containing additives, oxidation products and the like comprising:

a. vacuum-distilling the used oil to strip water and volatile materials boiling below 600°–700° F;
b. mixing the stripped oil with a solvent consisting of about 1 part 2-propanol, about part 1 methylethyl ketone and about 2 parts 1-butanol, whereby the oil dissolves in the solvent and the additives, oxidation products and the like precipitate out as a sludge forming a partially purified oil;
c. separating the partially purified oil-solvent mixture from the sludge;
d. separating the partially purified oil from the solvent solution;
e. vacuum-distilling the partially purified oil and collecting the distillate overhead boiling from about 700° to about 1000° F, thereby forming a lubricating oil distillate;
f. decolorizing and deodorizing the lubricating oil distillate, thereby forming a lubricating oil base; and
g. mixing the lubricating oil base with appropriate additives and viscosity index improvers to form a finished lubricating oil.

2. The process of claim 1 wherein 1 part of used lubricating oil is mixed with about 3 to 8 parts solvent solution.

3. The process of claim 2 wherein step (e) is a fractional vacuum distillation, and the distillate overhead is collected in a plurality of boiling range cuts, thereby forming a plurality of lubricating oil distillate fractions of different viscosities.

4. The process of claim 3 wherein the distillate fractions are separately decolorized and deodorized, thereby forming a plurality of blending stocks of different viscosities.

5. The process of claim 4 including additional step (h) wherein blending stocks of different viscosities are blended together to prepare the lubricating oil base having a predetermined viscosity.

6. The process of claim 5 wherein the distillate fractions are decolorized and deodorized by clay-contacting.

7. The process of claim 6 wherein the distillate fractions are mixed with acid-activated bleaching clay in a ratio of about 0.2 to 1 pound of clay per gallon of lubricating oil to form a mixture, heating the mixture to 300° to 500° F for 30 minutes to 3 hours and separating the fractions from the clay, thereby forming the blending stocks.

8. The process of claim 5 wherein the distillate fractions are decolorized and deodorized by mild hydrogenation.

9. The process of claim 8 wherein the distillate fractions are contacted with hydrogen at a temperature of 500° to 700° F at a hydrogen partial pressure of 400 to 900 psig in the presence of a hydrofinishing catalyst, whereby the fractions are decolorized and deodorized, thereby forming the blending stocks.

10. The process of claim 3 wherein the lubricating oil distillate fractions of different viscosities are blended together to form a blended distillate having a predetermined viscosity before being decolorized and deodorized.

11. The process of claim 10 wherein the blended distillate fractions are decolorized and deodorized by claycontacting.

12. The process of claim 11 wherein the blended distillate fractions are mixed with acid-activated bleaching clay in a ratio of .2 to 1 pound of clay per gallon of lubricating oil to form a mixture, heating the mixture to 300° to 500° F for periods of 30 minutes to 3 hours and separating the fractions from the clay, thereby forming the blending stocks.

13. The process of claim 10 wherein the blended distillate fractions are decolorized and deodorized by mild hydrogenation.

14. The process of claim 13 wherein the blended distillate fractions are contacted with hydrogen at a temperature of 500° to 700° F at a hydrogen partial pressure of 400 to 900 psig in the presence of a hydrofinishing catalyst, whereby the fractions are decolorized and deodorized.

* * * * *